US010443324B2

(12) United States Patent
Teo et al.

(10) Patent No.: US 10,443,324 B2
(45) Date of Patent: Oct. 15, 2019

(54) GYROSCOPIC HANG-OFF SYSTEM

(71) Applicant: Nustar Technologies Pte Ltd, Singapore (SG)

(72) Inventors: Sim Guan Teo, Singapore (SG); Nur Adlina Binte Suhaimi, Singapore (SG); Terence Lim, Singapore (SG); Kim Kok Goi, Singapore (SG); Kyaw Thet, Singapore (SG)

(73) Assignee: Nustar Technologies Pte Ltd, Singapore (SG)

( * ) Notice: Subject to any disclaimer, the term of this patent is extended or adjusted under 35 U.S.C. 154(b) by 0 days.

(21) Appl. No.: 15/784,206

(22) Filed: Oct. 16, 2017

(65) Prior Publication Data

US 2018/0112474 A1 Apr. 26, 2018

Related U.S. Application Data

(60) Provisional application No. 62/410,872, filed on Oct. 21, 2016.

(51) Int. Cl.
*E21B 19/00* (2006.01)
*E21B 17/01* (2006.01)

(52) U.S. Cl.
CPC ..... *E21B 19/004* (2013.01); *E21B 17/01* (2013.01)

(58) Field of Classification Search
CPC ..... E21B 17/01; E21B 19/004
See application file for complete search history.

(56) References Cited

U.S. PATENT DOCUMENTS 3,058,357 A * 10/1962 Flschel ..... G01C 19/42 74/5.4
3,071,012 A * 1/1963 Baring-Gould ..... G01C 21/18 33/317 R
3,091,127 A * 5/1963 Depp ..... G01C 19/36 33/317 R
3,313,345 A * 4/1967 Fischer ..... E21B 7/128 166/355
3,496,898 A * 2/1970 Morgan ..... E21B 7/128 114/294

(Continued)

FOREIGN PATENT DOCUMENTS

JP 55395101 A 8/1978
JP 108319789 A 12/1996

(Continued)

*Primary Examiner* — Matthew R Buck
*Assistant Examiner* — Aaron L Lembo
(74) *Attorney, Agent, or Firm* — Horizon IP Pte. Ltd.

(57) ABSTRACT

A hang-off gimbal system is disclosed. The hang-off gimbal system comprises a gimbal assembly. The gimbal assembly includes a gimbal frame with a passage therethrough. A first gimbal module is disposed within the passage of the gimbal frame. The first gimbal module comprises a passage therethrough. A second gimbal module is disposed within the passage of the first gimbal module. The second gimbal module comprises a passage therethrough. The second gimbal module extends upwardly beyond the gimbal frame and first gimbal module. An adapter sleeve is disposed in the passage of the second gimbal module. The adapter sleeve comprises a passage therethrough. The adapter sleeve protrudes upwardly and protrudes above the second gimbal module.

20 Claims, 11 Drawing Sheets

(56) References Cited

U.S. PATENT DOCUMENTS 3,526,145 A * 9/1970 Riordan ..... G01C 19/02 73/504.09
3,733,834 A * 5/1973 Ludwig ..... E02B 17/00 114/124
3,982,714 A * 9/1976 Kuhn ..... F41G 7/2213 244/3.16
4,068,868 A * 1/1978 Ohrt ..... E21B 17/085 285/223
4,088,089 A * 5/1978 Flory ..... B63B 27/24 114/230.14
4,173,360 A * 11/1979 Bergman ..... F16L 27/103 285/223
4,200,054 A 4/1980 Elliston
4,563,909 A * 1/1986 Carroll ..... G01C 19/22 74/5.46
4,729,694 A 3/1988 Peppel
4,729,753 A 3/1988 Neathery et al.
4,984,827 A * 1/1991 Peppel ..... F16L 27/103 285/123.17
5,269,629 A * 12/1993 Langner ..... F16L 27/103 166/367
6,739,804 B1 * 5/2004 Haun ..... E21B 17/015 166/355
8,348,552 B2 * 1/2013 Pionetti ..... B63B 35/03 405/166
9,010,436 B2 * 4/2015 Kubichek ..... E21B 19/004 166/355
9,988,860 B2 * 6/2018 Salem ..... E21B 17/085
2008/0035351 A1 * 2/2008 Masters ..... E21B 17/01 166/367
2014/0265310 A1 9/2014 Halkyard et al.
2014/0274427 A1 9/2014 Foskey et al.
2015/0136412 A1 * 5/2015 Hafernik ..... E21B 19/002 166/360
2018/0155994 A1 * 6/2018 Wajnikonis ..... E21B 19/004

FOREIGN PATENT DOCUMENTS

JP 2016517496 A 6/2016
WO 2015022425 A1 2/2015
WO 2017040798 A1 3/2017

* cited by examiner

Detail B

GYROSCOPIC HANG-OFF SYSTEM

CROSS-REFERENCE TO RELATED APPLICATION

This application claims the benefit of U.S. Provisional Application Ser. No. 62/410,872, filed on Oct. 21, 2016, which is herein incorporated by reference in its entirety for all purposes.

BACKGROUND

Offshore drilling and production operations often utilize a column of pipes to facilitate the controlled routing of oil, gas, minerals or other deposits located subsea, to an offshore platform. The pipes may be riser pipes coupled serially end-to-end to form a riser string. The offshore platform may be a fixed platform (e.g., drilling or mining rig) or floating platform (e.g., marine vessel). The lower end of the riser string may be connected to a subsea drilling or production equipment, including a sea floor mining unit, or other associated subsea equipment, while the upper end of the riser string is supported by support structures located above sea level. Typically, a riser string is supported by a spider fitted into the opening of a rotary table installed on the offshore platform. The spider may include a slip bowl in which slips are peripherally distributed to surround the section (e.g., riser pipe) of the riser string to be gripped.

Riser strings deployed in subsea operations may include hundreds of vertical pipes serially connected by riser couplings (or riser joints), depending on the desired operating depth. The offshore operating environment inevitably exposes the riser string to extreme mechanical stresses. For example, riser strings supported by offshore floating platforms, including marine vessels, are exposed to cyclic bending stresses and torsional shock loading due to pitch and roll motions of the platform caused by strong wave and current forces during adverse weather or sea conditions. These undue mechanical stresses may occur during installation or operation of the riser string, and will invariably lead to stress-related material fatigue failure.

Therefore, it is desirable to provide support structures which can mitigate the cyclic stresses acting on the riser string during subsea operations to improve reliability and performance of the riser string.

SUMMARY

Embodiments of the present disclosure generally relate to a pivoted support system for facilitating subsea drilling and production operations. In one embodiment, a gimbal assembly is disclosed. The gimbal assembly comprises a gimbal frame with a passage therethrough. A first gimbal module is concentrically disposed within the passage of the gimbal frame, wherein the first gimbal module comprises a passage therethrough. A second gimbal module is concentrically disposed within the passage of the first gimbal module, wherein the second gimbal module comprises a passage therethrough, wherein the second gimbal module extends upwardly beyond the gimbal frame and first gimbal module. An adapter sleeve is disposed in the passage of the second gimbal module, wherein the adapter sleeve comprises a passage therethrough. The adapter sleeve extends upwardly and protrudes above the second gimbal module.

In another embodiment, a pivotal hang-off system is disclosed. The hang-off system comprises a gimbal frame with a passage therethrough. A first gimbal module is disposed within the passage of the gimbal frame, wherein the first gimbal module comprises a passage therethrough. A second gimbal module is disposed within the passage of the first gimbal module, wherein the second gimbal module comprises a passage therethrough, wherein the second gimbal module extends upwardly beyond the gimbal frame and first gimbal module. An adapter sleeve is disposed in the passage of the second gimbal module, wherein the adapter sleeve comprises a passage therethrough. The adapter sleeve extends upwardly and protrudes above the second gimbal module. A tubular member comprising a shaft collar is removably fastened to an outer circumferential surface of the tubular member, wherein the tubular member is slidably mounted into the passage of the second gimbal module. The shaft collar is seated on the adapter sleeve In yet another embodiment, a system for obtaining natural resources subsea is disclosed. The system comprises a column of pipes dynamically supported by a gimbal assembly. The gimbal assembly comprises a gimbal frame with a passage therethrough. A first gimbal module is disposed within the passage of the gimbal frame, wherein the first gimbal module comprises a passage therethrough. A second gimbal module is disposed within the passage of the first gimbal module, wherein the second gimbal module comprises a passage therethrough, wherein the second gimbal module extends upwardly beyond the gimbal frame and first gimbal module. An adapter sleeve is disposed in the passage of the second gimbal module, wherein the adapter sleeve comprises a passage therethrough. The adapter sleeve extends upwardly and protrudes above the second gimbal module. A shaft collar is releasably fastened to the column of pipes, wherein the column of pipes is slidably mounted into the passage of the second gimbal module and the shaft collar engages the adapter sleeve. The column of pipes extends from an offshore platform to below sea level and facilitates controlled routing of natural resources subsea.

These and other advantages and features of the embodiments herein disclosed, will become apparent through reference to the following description and the accompanying drawings. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure. In the following description, various embodiments of the present disclosure are described with reference to the following drawings, in which.

DETAILED DESCRIPTION

The following discussion is directed to various embodiments of the invention. It is to be appreciated that the following description has broad applications, and the discussion of any embodiment is meant only to be exemplary of that embodiment, and should not be interpreted, or otherwise used, as limiting the scope of the disclosure, including the claims.

Embodiments of the present disclosure generally relate to a dynamic hang-off system for subsea drilling, production and/or mining operations. More particularly, some embodiments relate to a stress dampening device employed to dynamically support one or more tubular members extending downwardly from an offshore floating platform. In one embodiment, the stress dampening device is employed to pivotally support a string (or column) of tubular members. For example, the stress dampening device provides a flexible hang-off point for a plurality of vertical pipes connected in series, including riser pipes and other related subsea equipment. The stress dampening device may be a gyroscopic device. For example, the stress dampening device includes a gimbal assembly having a first gimbal module rotatably coupled to a second gimbal module. In one embodiment, the gimbal assembly is positioned above sea level to hang down a string of tubular members that extend downwardly below sea level. For example, the gimbal assembly may be installed subsea, including on a marine vessel, to provide the supported tubular members with a compliant support structure to mitigate the exposure to extreme mechanical stresses during subsea operations. Deploying the gimbal assembly on other types of offshore platforms, including a rig (e.g., oil and gas rigs), may also be useful.

Figure 1A:
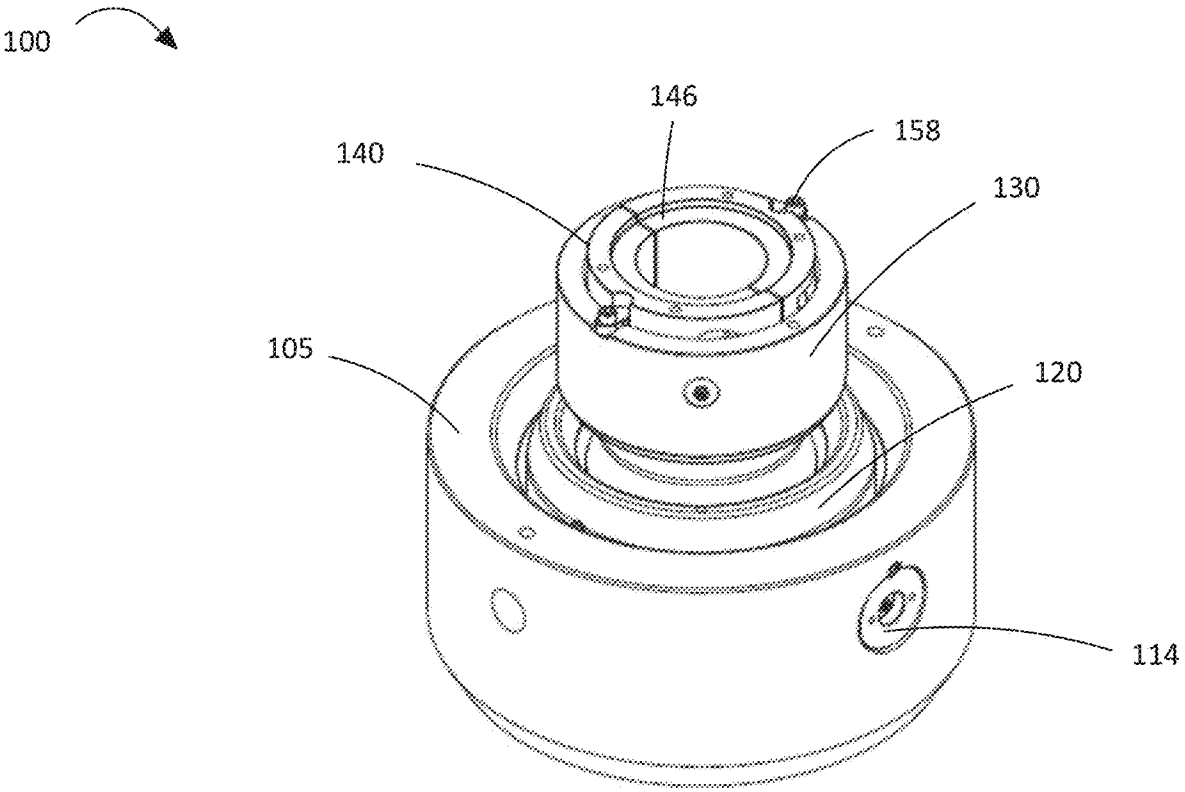
FIG. 1*a* shows a perspective view of an embodiment of a gimbal assembly.
Figure 1B:
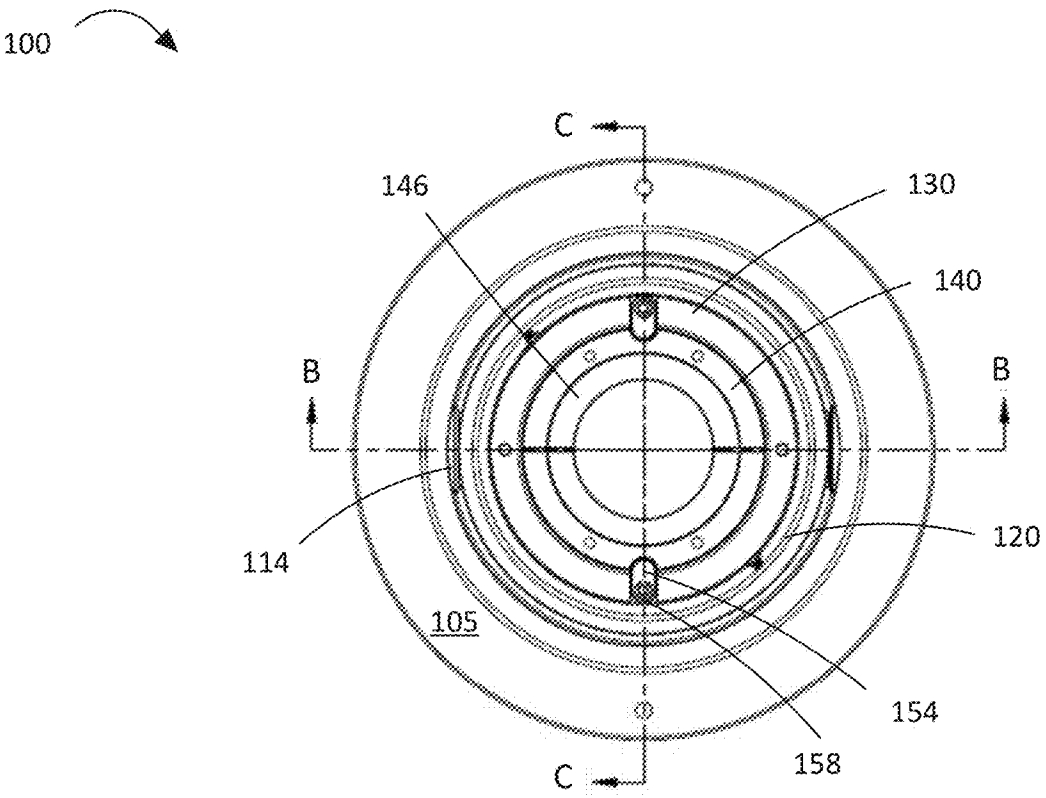
FIG. 1*b* shows a top view of the gimbal assembly of FIG. 1*a;*
Figures 1C, 1D:
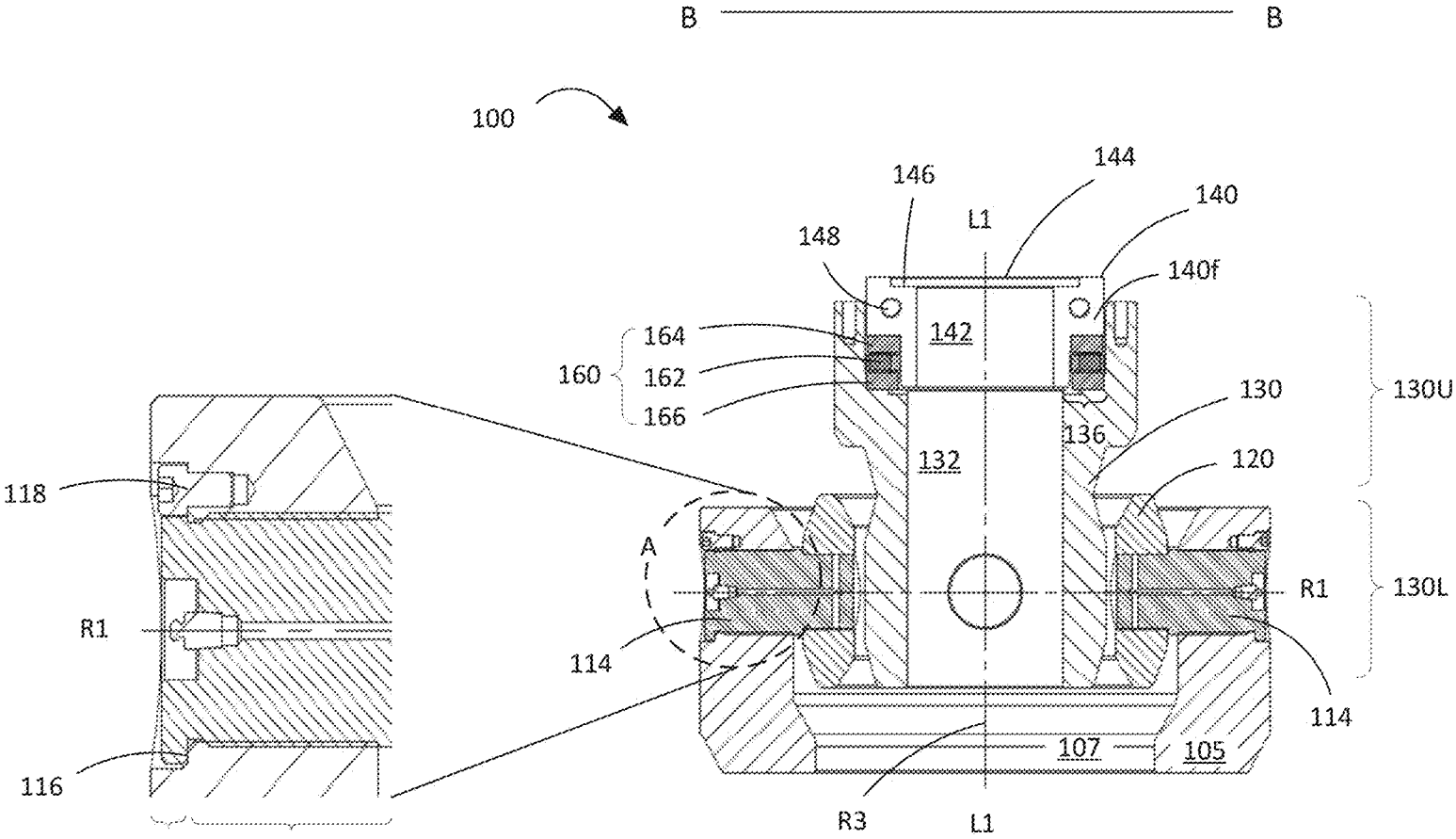
FIG. 1*c* shows a cross-sectional view of the gimbal assembly of FIG. 1*a* taken along the B-B plane shown in FIG. 1*b*.
FIG. 1*d* shows an enlarged view of the detail area A of FIG. 1*c;*
Figures 1E, 1F:
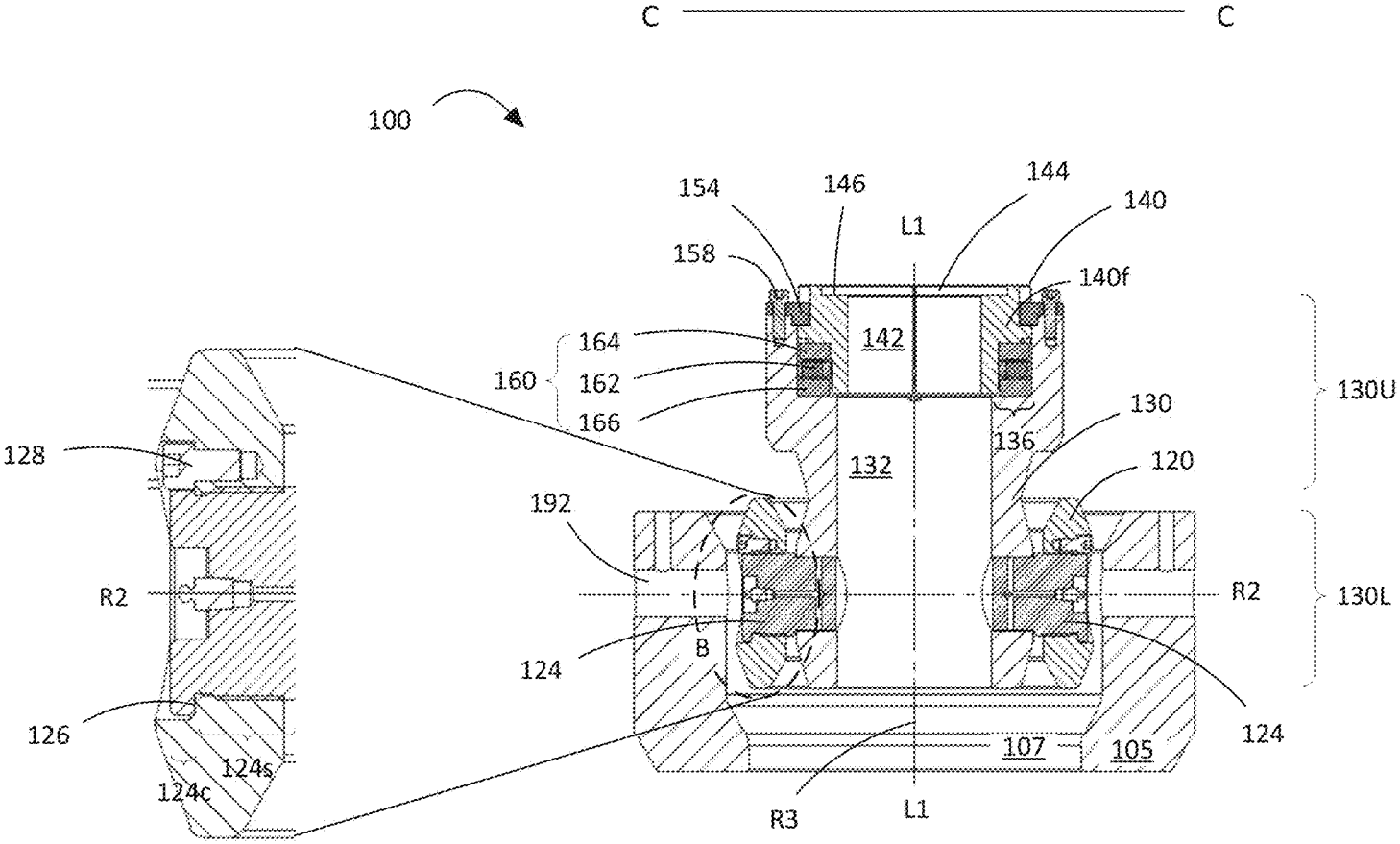
FIG. 1*e* shows a cross-sectional view of the gimbal assembly of FIG. 1*a* taken along the C-C plane shown in FIG. 1*b*.
FIG. 1*f* shows an enlarged view of the detail area B of FIG. 1*e;*

FIGS. 1*a*-1*f* illustrate multiple views of a gimbal assembly 100 in accordance with one or more embodiments of the present disclosure. Specifically, FIG. 1*a* shows a perspective view of the gimbal assembly 100, FIG. 1*b* shows a top view of the gimbal assembly 100, FIG. 1*c* shows a cross-sectional view of the gimbal assembly 100 taken along the B-B plane shown in FIG. 1*b*, FIG. 1*d* shows an enlarged view of the detail area A of FIG. 1*c*, FIG. 1*e* shows a cross-sectional view of the gimbal assembly 100 taken along the C-C plane shown in FIG. 1*b*, and FIG. 1*f* shows an enlarged view of the detail area B of FIG. 1*e*.

As shown, the gimbal assembly 100 includes a first circular member 105 with a passage 107 therethrough. The first circular member 105 may be a tool body housing the gimbal assembly. For example, the first circular member 105 defines a gimbal housing or frame (hereinafter "housing"). In one embodiment, the housing 105 is configured to interface with conventional support structures (not shown) on an offshore platform. The housing 105 is, for example, configured for mounting onto a slip bowl of a rotary table spider installed within a marine vessel. Although a ring-shaped housing 105 is shown, it should be appreciated that the housing may include any suitable shape with a passage therethrough, depending on design requirements.

In one embodiment, the housing 105 encompasses a second circular member 120 with a passage therethrough. The second circular member 120, for example, includes a smaller annular dimension relative to the housing 105 and is concentrically disposed in the passage of the housing 105. The second circular member 120 is rotatably coupled to the housing 105 and defines an outer gimbal module of the gimbal assembly 100. Other configurations of outer gimbal module 120 and housing 105 may also be useful. Although a ring-shaped outer gimbal module 120 is shown, it should be appreciated that the outer gimbal module 120 may include any suitable shape with a passage therethrough, depending on design requirements. The outer gimbal module 120 may be referred to as an outer gimbal ring.

The gimbal assembly 100 includes an inner gimbal module 130 concentrically disposed in the passage of the outer gimbal module 120. For example, inner gimbal module 130 includes a smaller annular dimension relative to the outer gimbal module 120. The inner gimbal module 130 may be an elongated annular member having a passage 132 extending therethrough. In one embodiment, the inner gimbal module is partially exposed above the outer gimbal module 120. For example, the inner gimbal module 130 includes a lower portion 130L disposed within the passage of the outer gimbal module 120 and an upper portion 130U protruding above the outer gimbal module 120. The inner gimbal module 130 is rotatably coupled to the outer gimbal module 120. Other configurations of outer and inner gimbal modules 120 and 130 may also be useful. Although a tubular-shaped inner gimbal module 130 is shown, it should be appreciated that the inner gimbal module 130 may include any suitable shapes with a passage therethrough, depending on design requirements. The inner gimbal module 130 may be referred to as an inner gimbal ring.

The lower portion 130L of the inner gimbal module 130 is configured for coupling to the outer gimbal module 120 while the upper portion 130U of the inner gimbal module 130 is configured to accommodate an adapter sleeve 140. In one embodiment, the adapter sleeve 140 is a circular member mounted within the passage 132 of the inner gimbal module 130. The adapter sleeve 140, for example, includes a passage 142 extending therethrough. The passage 142 of the adapter sleeve 140 is directly adjacent to and in communication with the passage 132 of the inner gimbal module 130 to define a gimbal assembly slot for slidably mounting one or more tubular members, as will be described in detail later. The gimbal assembly 100 includes a central axis line L1 defined therethrough, and the various elements of the gimbal assembly 100 are formed along and/or radially about the central axis line L1, as shown particularly in FIGS. 1*c*-1*d*. The central axis line L1 of the gimbal assembly extends vertically through the center of the gimbal assembly slot.

Referring to FIGS. 1*c*-1*d*, a plurality of gimbal pivot axle mounting apertures (hereinafter "pivot aperture") are disposed within the gimbal assembly 100, including the housing 105. For example, the plurality of pivot apertures extend through the housing 105, outer gimbal module 120 and lower portion 130L of the inner gimbal module 130. In one embodiment, the plurality of pivot apertures includes first type pivot apertures disposed in the housing 105 and the outer gimbal module 120, and second type pivot apertures disposed in the outer gimbal module 120 and the lower portion 130L of the inner gimbal module 130. For example, the first type pivot apertures in the housing 105 are in alignment with the second type pivot apertures in the outer gimbal module 120, and the first type pivot apertures in the outer gimbal module 120 are in alignment with the second type pivot apertures in the inner gimbal module 130.

The first and second type pivot apertures are configured for receiving pivotal connectors to rotatably couple the inner gimbal module 130 to the outer gimbal module 120, and to rotatably couple the outer gimbal module 120 to the housing 105. In on embodiment, the pivotal connectors include a T-shaped structural profile. The pivotal connectors, for example, include an axially elongated annular body (or stem) having a radially enlarged flange (or collar) extending from one end thereof. The pivotal connectors, for example, include pivot pins or bolts. Other types of connector may also be used to provide a pivotal connection.

In one embodiment, a first pair of pivot pins 114 is disposed diametrically opposite of each other in the first and second type pivot aperture, as shown particularly in FIGS. 1*c* and 1*d*. The first pair of pivot pins 114, for example, extends through the first type pivot apertures in the housing 105 and traverses the passage 107 of the housing 105 to removably engage the second type pivot apertures in the outer gimbal module 120. The flanged end or collar 114*c* of the pivot pins 114 is disposed within the first type pivot aperture and proximate to the outer circumferential surface of the housing 105. The stem 114*s* of the pivot pins 114 extend inwardly along a first horizontal axis to removably engage the housing 105 and outer gimbal module 120 for rotation of the outer gimbal module 120 about the axis of the pivot pins 114. The first pair of pivot pins 114 defines a first rotational axis R1 of the gimbal assembly 100 and may be referred to as outer pivot pins.

In one embodiment, a second pair of pivot pins 124 is disposed diametrically opposite of each other in the first and second type pivot apertures, as shown particularly in FIGS. 1*e* and 1*f*. The second pair of pivot pins 124, for example, extends through the first type pivot apertures in the outer gimbal module 120 and traverses the passage of the outer gimbal module 120 to removably engage the second type pivot apertures in lower portion 130L of the inner gimbal module 130. The flanged end or collar 124*c* of the pivot pins 124 is disposed within the first type pivot aperture and proximate to the outer circumferential surface of the outer gimbal module 120. The stem 124*s* of the pivot pins 124 extend inwardly along a first horizontal axis to removably engage the outer and inner gimbal modules 120 and 130 for rotation of the inner gimbal module 130 about the axis of the pivot pins 124. The second pair of pivot pins 124 defines a second rotational axis R2 of the gimbal assembly 100 and may be referred to as inner pivot pins.

In one embodiment, the inner and outer pivot pins 114 and 124 are aligned to substantially the same axial (or transverse) plane. Each of the outer pivot pins 114 is, for example, positioned about ninety degrees (90°) away from each of the inner pivot pins 124 such that the first rotational axis R1 is perpendicular to the second rotational axis R2 of the gimbal assembly 100. The first rotational axis R1 may correspond to the lateral axis and the second rotational axis R2 may correspond to the longitudinal axis of the gimbal assembly 100. Other designations of first and second rotational axes may also be useful. For example, having R1 correspond to the longitudinal axis and R2 correspond to the lateral axis may also be useful. Although the first and second pair of pivot pins 114 and 124 are shown as aligned to about the same axial plane, it should be appreciated that the first and second pair of pivot pins may also be positioned on different axial planes without departing from the spirit of the present invention.

The outer and inner pivot pins 114 and 124 are configured to provide high compressive load carrying capacity. In one embodiment, the outer and inner pivot pins 114 and 124 include annular dimensions (or thickness) sufficient to provide the desired compressive load carrying capacity. For example, the outer and inner pivot pins 114 and 124 include a same or similar annular dimension defined by a desired load rating. Providing outer and inner pivot pins having different annular dimensions may also be useful. In one embodiment, the outer pivot pins 114 include a longer axial dimension relative to the inner pivot pins 124. The outer and inner pivot pins 114 and 124, for example, include axial dimensions (or length) sufficient to traverse substantially the entire length of the corresponding pivot apertures. Providing other configurations of inner and outer pivot pins may also be useful depending on design requirements.

As shown, the first and second type pivot apertures of the gimbal assembly 100 are configured to accommodate the pivot pins, such that the pivot pins 114 and 124 are completely seated within the corresponding pivot apertures. For example, the first and second type pivot apertures may include different configurations to accommodate the profile of the pivotal connectors. Providing first and second type pivot apertures having a same configuration may also be useful depending on the profile of the pivotal connectors. In this case, the first type pivot apertures in the housing 105 and outer gimbal module 120 are formed with a shallow radial groove adjacent to and in communication with a cylindrical bore extending through the first type pivot aperture. The shallow radial groove is, for example, disposed about an outer end of the cylindrical bore to provide the first type pivot apertures with a radially enlarged portion for seating the collar 114*c* and 124*c* of the pivot pins. In one embodiment, the second type pivot apertures include a cylindrical bore, same as that of the first type pivot apertures, extending throughout. The second type pivot apertures are, for example, devoid of a radial groove.

The radial groove of the first type pivot apertures is dimensioned to accommodate a radial expense of the collar of the pivot pins 114 and 124 while the cylindrical bore of the first type pivot aperture is dimensioned to accommodate the elongated body of the pivot pins 114 and 124. As such, the difference in annular dimensions of the radial groove with respect to the cylindrical bore of the first type pivot apertures defines an inner mounting surface 116 and 126 within the first type pivot apertures for engaging the collar 114*c* and 124*c* of the pivot pins, as shown particularly in FIGS. 1*d* and 1*f*.

The pivot pins 114 and 124 are removably fastened to their final (or functional) positions within the corresponding pivot apertures by means of removable fasteners to facilitate the ease of removal and replacement of the pivot pins 114 and 124. For example, each of the outer pivot pins 114 is fastened to the inner mounting surface 116 by means of a first removable fastener 118 and each of the inner pivot pins 124 is removably fastened to the inner mounting surface 126 by means of a second removable fastener 128. In one embodiment, the removable fasteners 118 and 128 may be a threaded fastener, such as a socket head cap screw. For example, the same type of fastener is employed to removably secure the outer and inner pivot pins 114 and 124 in position. Other suitable types of removable fastener may also be employed. Providing the outer and inner pivot pins with different types of removable fasteners may also be useful.

The inner mounting surface 116 of the first type pivot apertures in the housing 105 provides a surface interaction between the collar 114*c* of the outer pivot pins 114 and the housing 105 while the inner mounting surface 126 of the second type pivot apertures in the outer gimbal module 120 provides a surface interaction between the collar 124*c* of the inner pivot pins 124 and the outer gimbal module 120. The inner mounting surfaces 116 and 126 of the pivot apertures are dimensioned to provide a sufficient surface interaction with the collars 114*c* and 124*c* of the pivot pins to resist rotation when the pivot pins 114 and 124 are tightened to a predetermined torque. The predetermined torque, for example, induces sufficient compressive load on the inner mounting surface 116 and 126 to achieve a specific friction requirement determined to secure the pivot pins 114 and 124 in their functional positions within the pivot apertures when the gimbal assembly 100 is in operation. In addition, the removable fasteners 118 and 128 function as anti-rotation keys for preventing loosening engagement between the pivot pins 114 and 124 and the corresponding mounting surfaces 116 and 126 within the first type pivot apertures.

The upper portion 130U of the inner gimbal module 130 is configured to accommodate an adapter sleeve 140, as shown. In one embodiment, the annular passage 132 of the inner gimbal module 130 includes a first bore having a first inner diameter and a second bore having a second inner diameter which is smaller than the first inner diameter. The first bore is in communication with the second bore. For example, the first bore is positioned within the upper portion 130U of the inner gimbal module 130 and provides a radially enlarged opening to accommodate the adapter sleeve 140, while the second bore is a cylindrical bore extending downwardly from the first bore through the upper and lower portions 130U and 130L of the inner gimbal module 130. The difference in annular dimensions of the first bore with respect to the second bore of the passage 132 defines an annular shoulder 136 within the upper portion 130U of the inner gimbal module 130.

In one embodiment, a bearing assembly 160 is slidably mounted to the annular shoulder 136 in the first bore of the inner gimbal module 130. For example, the annular shoulder 136 is dimensioned to fully engage the bottom of the bearing assembly 160. The bearing assembly 160 may be a cylindrical shaped bearing assembly having an annular passage extending therethrough. The cylindrical bearing assembly 160 is fully seated on the annular shoulder 136 of the inner gimbal module 130 and positioned in concentric relation to the annular passage of the inner gimbal module 130. The bearing assembly 160 includes a plurality of rolling elements 162 sandwiched between upper and lower race washers 164 and 166 and is configured to support a predominantly axial load. The bearing assembly 160 is, for example, rotatable about a vertical axis R3 which is perpendicular to the first and second rotational axes R1 and R2. The vertical axis R3 is substantially concentrically aligned to the central axis line L1 of the gimbal assembly and defines a third rotational axis of the gimbal assembly 100. The bearing assembly 160 provides a supported load with full rotational compliance about the vertical axis R3.

In one embodiment, an adapter sleeve 140 is mounted on top of the bearing assembly 160 and protrudes out from the inner gimbal module 130. The adapter sleeve 140 includes an annular passage 142 extending therethrough, and an upper segment having an outer diameter (or circumference) that is larger relative to the outer circumference of a lower segment of the adapter sleeve. The difference in the outer diameters of the upper segment with respect to the lower segment defines a radially extended flanged end 140*f* of the adapter sleeve 140. In one embodiment, the adapter sleeve 140 is slidably mounted within the first bore of the passage 132 of the inner gimbal module 130 such that the upper segment of the adapter sleeve is disposed on the bearing assembly 160 and protrudes upwardly beyond the first bore of the passage 132. For example, the flanged end 140*f* of the adapter sleeve 140 is seated on the upper race washer 164 of the bearing assembly 160, and the lower segment of the adapter sleeve 140 is slidably mounted into the annular passage of the bearing assembly 160. In one embodiment, the upper race washer 164 of the bearing assembly 160 provides a rotatable interface for the flanged end 140*f* of the adapter sleeve 140. Alternatively, it is understood that the bearing assembly 160 may also be configured to include additional ring members, including spacers or washers, between the flanged end 140*f* and the upper race washer 164 so as to rotatably support the adapter sleeve 140.

In one embodiment, the annular passage of the adapter sleeve 140 includes a shallow radial groove 144 disposed at an upper end of a cylindrical bore extending downwardly through the adapter sleeve 140. For example, the radial groove 144 includes a radially enlarged inner diameter relative to the inner diameter of the cylindrical bore. The difference in annular dimensions of the radial groove 144 with respect to the cylindrical bore of the adapter sleeve 140 defines an annular shoulder 146 within the passage 142 of the adapter sleeve 140 for mounting a tubular member, as will be described in more detail.

In one embodiment, the adapter sleeve 140 includes a vertical split therein. For example, the adapter sleeve 140 is an assembly of two half-rings. The split adapter sleeve 140 may include a pair of threaded connectors 148 horizontally threaded into openings of the flanged end 140*f* of each half-ring. The pair of threaded connectors 148 provides a threaded connection between the two half-rings to create compressive forces that fasten both halves of the adapter sleeve 140 together. The pair of threaded connectors 148 is, for example, a pair of fastening screws 148 disposed diametrically opposite of each other. Other suitable number and types of connectors may also be employed to compressively engage the two half-rings together to form the adapter sleeve 140. The pair of threaded connectors 148 may be completely recessed within the flanged end 140*f* of each half-ring. Other configurations of threaded connector within the adapter sleeve 140 may also be useful. It is appreciated that an unsplit adapter sleeve may also be employed.

The adapter sleeve 140 may be fastened to its final (or functional) position by means of removable fasteners to facilitate the ease of removal and replacement of the adapter sleeve 140. In one embodiment, the adapter sleeve 140 is removably fastened to the inner gimbal module 130 by means of a pair of threaded fasteners 158 and a pair of retaining brackets 154. The threaded fasteners are, for example, socket head cap screws. Other types of removable fastener may also be employed. As shown in FIG. 1*e*, the pair of threaded fasteners 158 and retaining brackets 154 are disposed diametrically opposite of each other. The retaining brackets 154 are removably mounted onto the top of the inner gimbal module 130 to restrict upward displacement of the adapter sleeve 140. The threaded fasteners 158 are provided to compressively engage the retaining brackets 154 to the upper portion 130U of the inner gimbal module 130.

The annular passages 132 and 142 of the inner gimbal module 130 and adapter sleeve 140 are disposed directly adjacent to each other. The annular passage 142 of the adapter sleeve 140 includes a smaller inner diameter relative to the annular passage 132 of the inner gimbal module 130. The adapter sleeve 140, in one embodiment, functions as a shaft (or bore) reducer for positioning a tubular member centrally within the inner gimbal module 130. For example, the annular passage 142 of the adapter sleeve 140 may be configured with a user-defined inner diameter so as to receive a tubular member having a predetermined annular dimension. For example, a plurality of adapter sleeves 140 may be dimensioned with a range of user-defined annular dimensions to enable tubular members of varying sizes to be reliably mounted within the inner gimbal module 130. Although, an adapter sleeve 140 having an annular passage 142 is described, it should be appreciated that the passage of the adapter sleeve 140 may include any suitable shape depending on the profile of the supported load. For example, the passage of the adapter sleeve 140 may also be configured to receive elongated members having a non-tubular profile.

The gimbal assembly 100 is formed of a material of sufficient strength to withstand all operational loads without detrimental permanent deformation and to withstand high axial shock loads without rupturing. For example, the various elements of the gimbal assembly may be formed of steel including, but not limited to, 4130 Alloy Steel, or some other similarly strong material. Moreover, it is understood that the gimbal assembly 100 may be configured to include oil feed slots 192 for maintenance purposes.

Figure 2A:
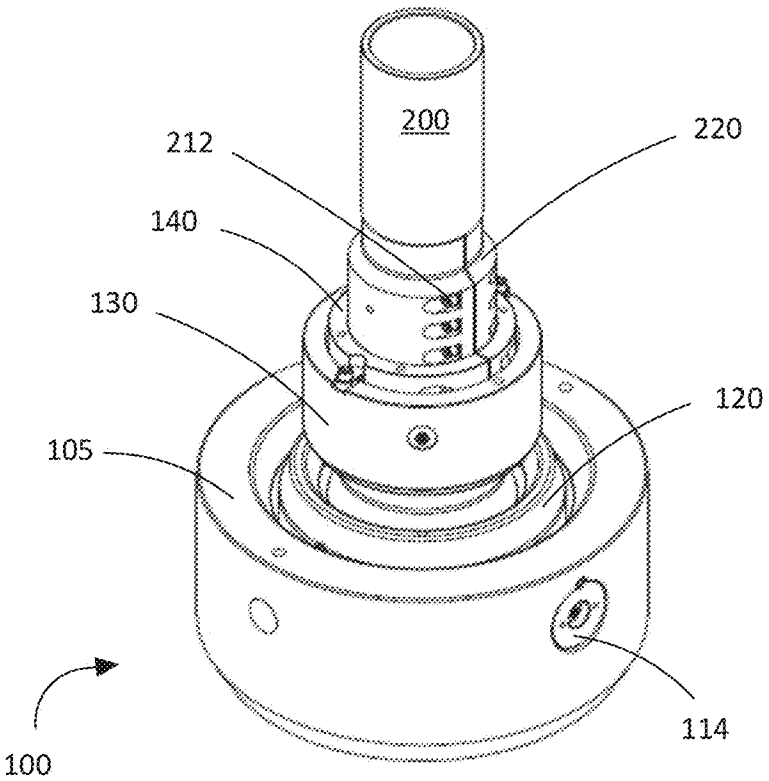
FIG. 2*a* shows a perspective view of an embodiment of a pivoted hang-off system.
Figure 2B:
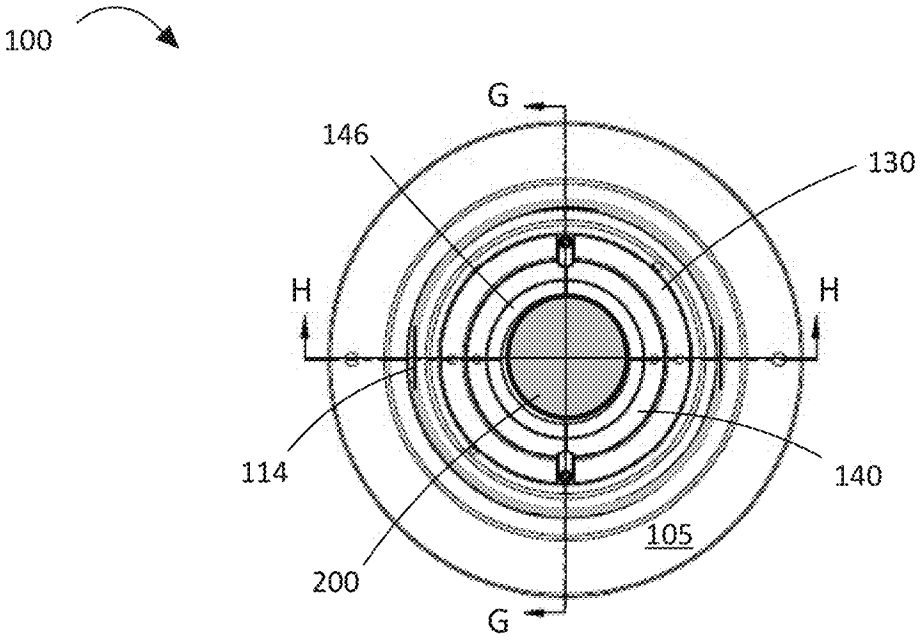
FIG. 2*b* shows a top view of the pivoted hang-off system of FIG. 2*a;*
Figure 2C:
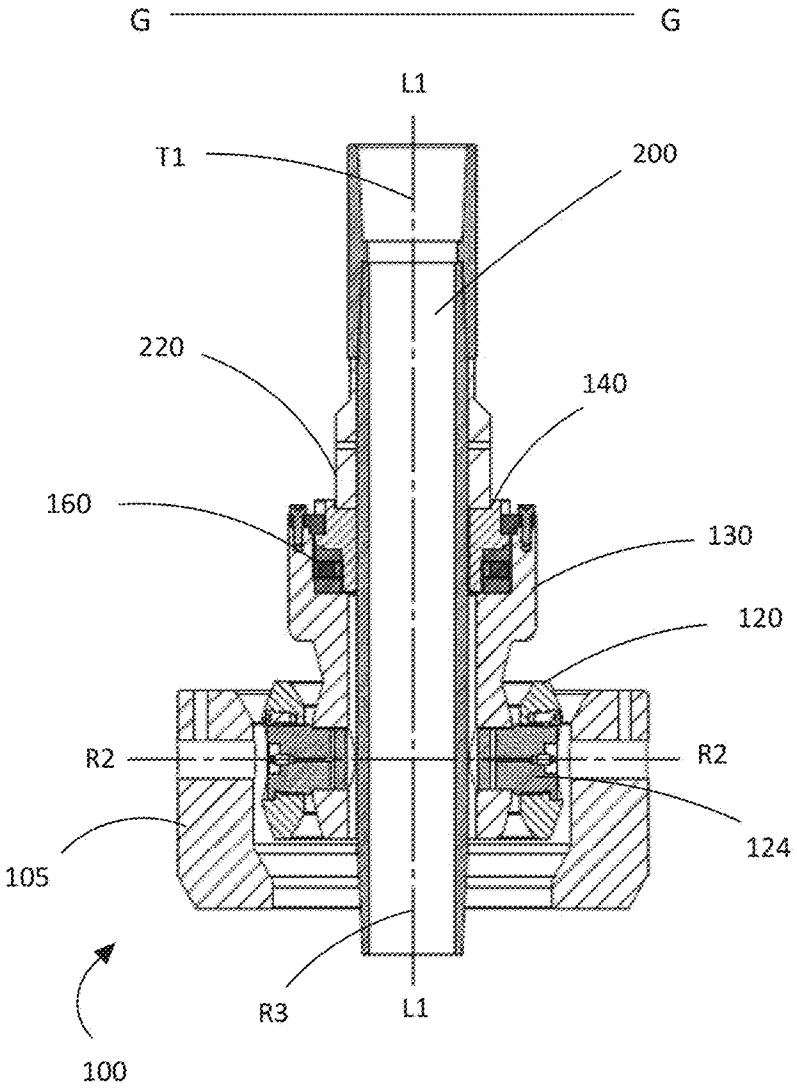
FIG. 2*c* shows a cross-sectional view of the pivoted hang-off system of FIG. 2*a* taken along the G-G plane shown in FIG. 2*b;*
Figure 2D:
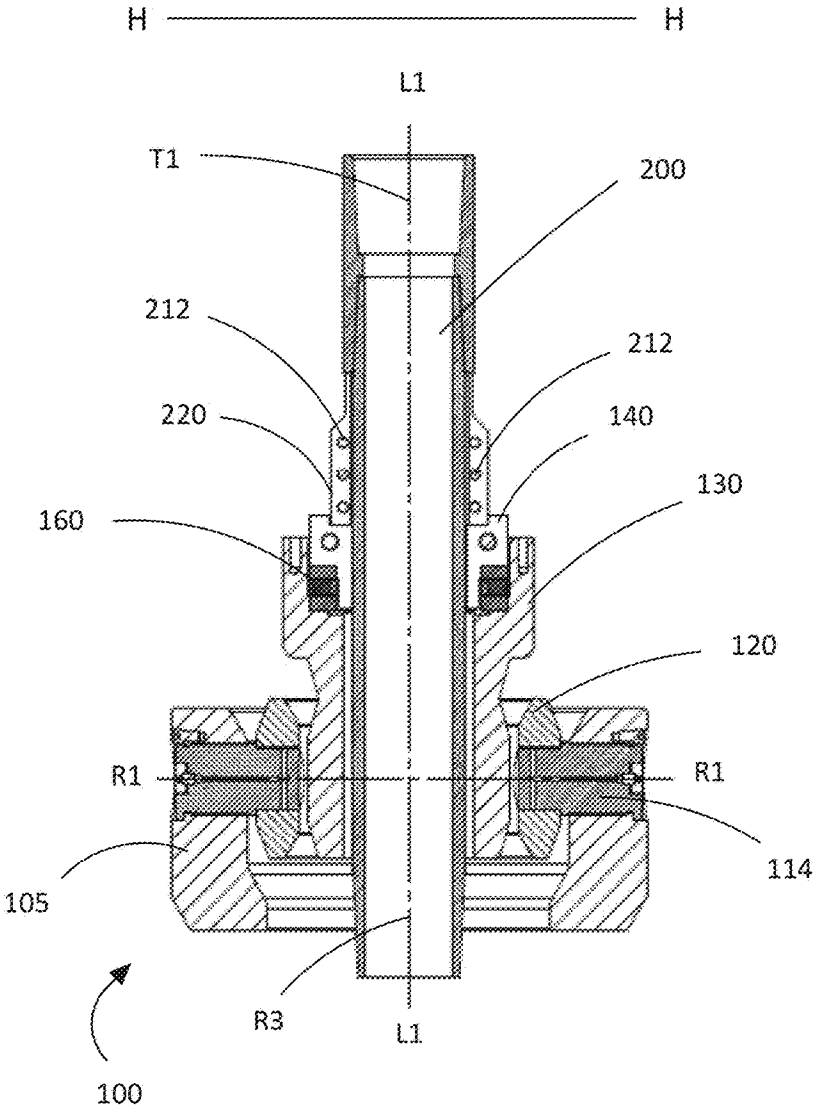
FIG. 2*d* shows a cross-sectional view of the pivoted hang-off system of FIG. 2*a* taken along the H-H plane shown in FIG. 2*b*.

FIGS. 2*a*-2*d* illustrate multiple views of a pivoted hang-off system in accordance with one or more embodiments of the present disclosure. Specifically, FIG. 2*a* shows a perspective view of the pivoted hang-off system supporting a tubular member 200, FIG. 2*b* shows a top view of the pivoted hang-off system of FIG. 2*a*, FIG. 2*c* shows a cross-sectional view of the pivoted hang-off system of FIG. 2*a* taken along the G-G plane shown in FIG. 2*b*, and FIG. 2*d* shows a cross-sectional view of the gimbal assembly 100 supporting the tubular member 200 taken along the H-H plane shown in FIG. 2*b*. In the interest of brevity, common elements may not be described or described in detail.

The pivoted hang-off system may include a gimbal assembly and a mounting attachment removably fastened to an elongated member to facilitate mounting of the elongated member onto the gimbal assembly. As shown, the pivoted hang-off system may include the gimbal assembly 100 as described in FIGS. 1*a*-1*e* and the elongated member may be a tubular member 200 concentrically disposed in the inner gimbal module 130. For example, the tubular member 200 is slidably mounted into the passage 132 of the inner gimbal module 130 and the passage 142 of the adapter sleeve 140. In one embodiment, the tubular member may be serially connected to a column of tubular members (not shown). For example, the tubular member 200 may be a riser pipe of a riser string. Other types of tubular members may also be useful. A mounting attachment 220 is removably fastened to the tubular member 200 and serves as the means for mounting the column of tubular members to the gimbal assembly 100. The mounting attachment 220 is, for example, a shaft collar. Employing other types of mounting attachment may also be useful.

The shaft collar 220, in one embodiment, includes a vertical split therein. For example, the shaft collar 220 is an assembly of two split collars. The shaft collar 220 may include multiple pairs of removable fasteners 212 recessed within the circumference to provide a threaded connection between the two split collars. Each pair of fastener is disposed diametrically opposite each other and tightened to create compressive forces that engage the two halves of the split collar 220 together and thereby attaching the split collar to the tubular member 200. The fasteners 212 removably fasten the shaft collar 220 to a temporary mounting position along the outer circumferential surface of the tubular member 200. For example, the shaft collar 220 is fastened to the outer circumferential surface of the tubular member by means of removable fasteners to facilitate repositioning of the shaft collar 220 as desired. The fasteners 212 may be loosened to adjust the shaft collar 220 to a different position along the tubular member 200. Alternatively, the shaft collar 220 may also be repositioned to a different tubular member within a column of serially connected tubular members. The shaft collar 220 provides the tubular member (or column of tubular members) with an adjustable mounting attachment for engaging the adapter sleeve 140.

In one embodiment, the radial groove 144 of the adapter sleeve 140 provides a radially enlarged opening for receiving the shaft collar 220 of the tubular member 200. For example, the tubular member 200 is slidably mounted into the passage 132 of the inner gimbal module 130 until the flanged body of the shaft collar 220 is seated onto the annular shoulder 146 of the adapter sleeve 140. Seating the shaft collar 220 onto the adapter sleeve 140 allows the downward axial load (or hanging load) of the tubular member 200 to be transferred to the inner gimbal module 130 such that the load of tubular member 200 is fully supported by the gimbal assembly 100. The shaft collar 220 facilitates the mounting of the tubular member 200 to the gimbal assembly 100.

Figure 3B:
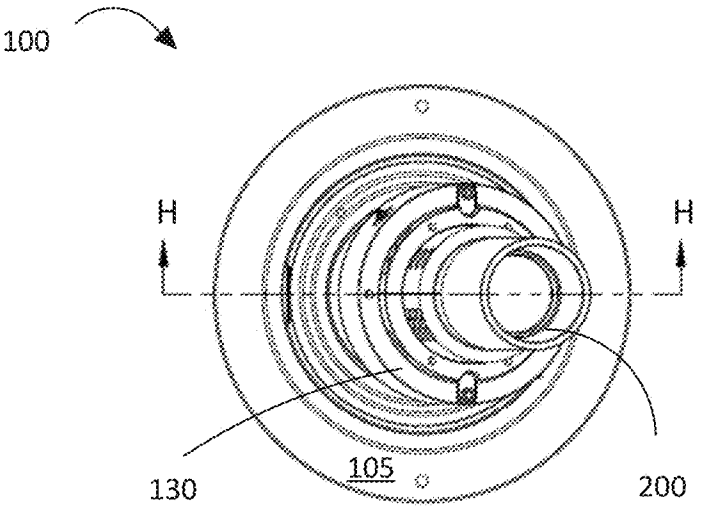
FIGS. 3*a*-3*d* show multiple views of the pivoted hang-off system of FIG. 2*a* in exemplary applications.
Figure 3A:
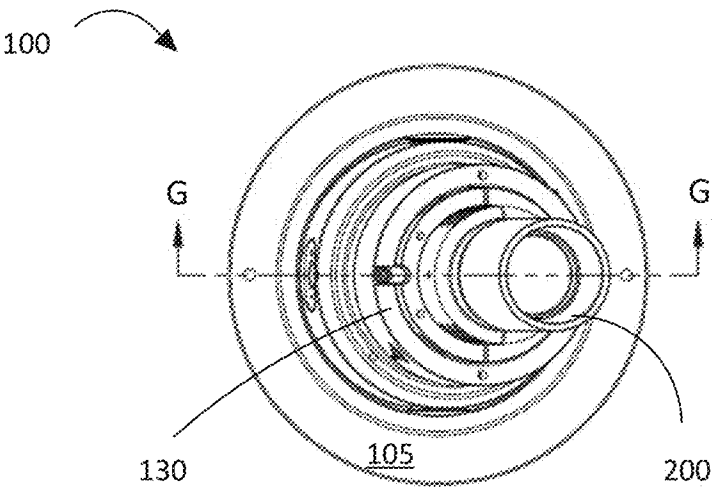
Figure 3C:
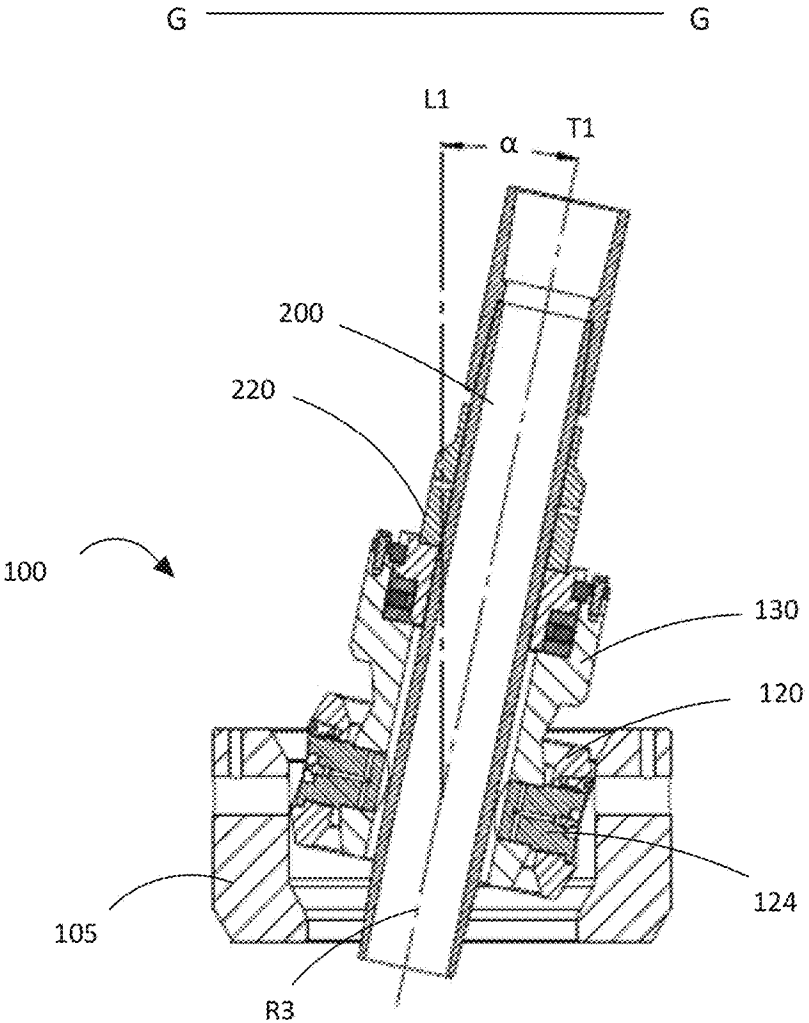
Figure 3D:
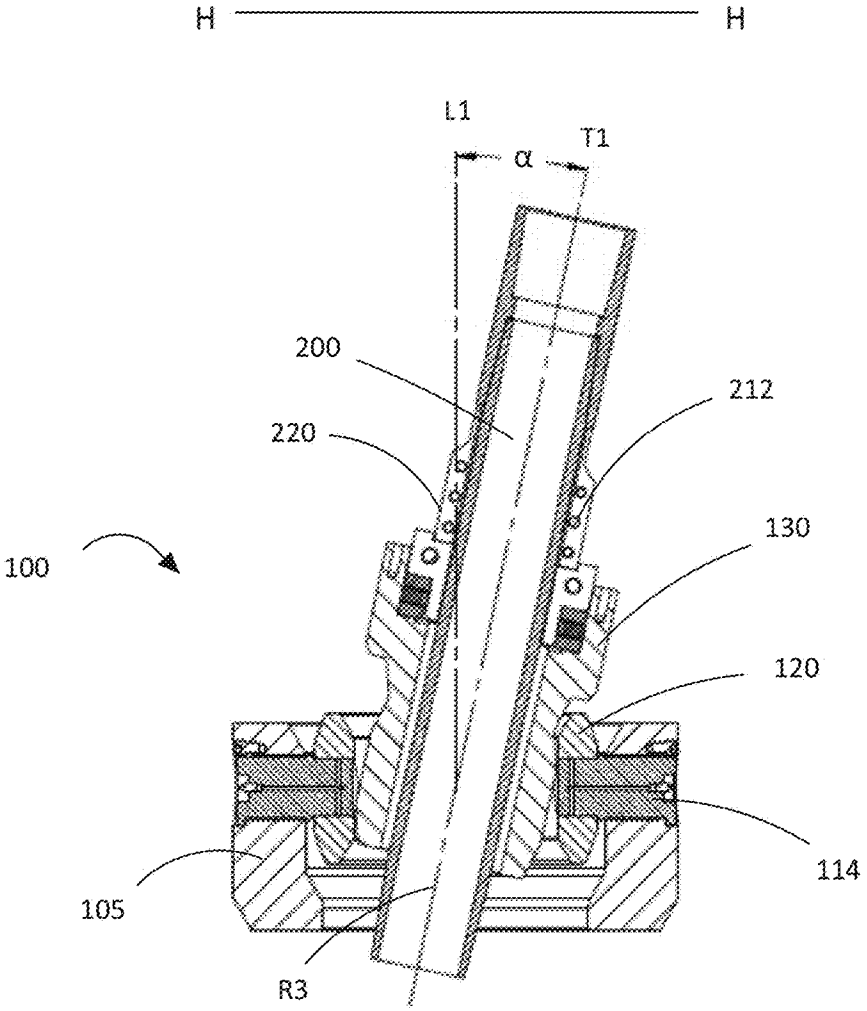

FIGS. 3*a*-3*d* illustrate multiple views of the pivoted hang-off system described in FIGS. 2*a*-2*d* operating in accordance with the embodiments of the present disclosure. Specifically, FIGS. 3*a* and 3*b* show top views of the pivoted hang-off system supporting the tilted tubular member 200, FIG. 3*c* shows a cross-sectional view of the pivoted hang-off system taken along the G-G plane shown in FIG. 3*a*, and FIG. 3*d* shows a cross-sectional view of the pivoted hang-off system taken along the H-H plane shown in FIG. 3*b*. In the interest of brevity, common elements may not be described or described in detail.

In one exemplary application, the gimbal assembly 100 provides the tubular member 200 with a vertical gyroscopic hang-off tool having a first rotational axis R1 disposed perpendicular to a second rotational axis R2 along a same axial plane. In particular, the tubular member 200 is mounted onto and fully supported by the adapter sleeve 140 by means of the shaft collar 220. The tubular member 200 includes a central axis line T1 defined therethrough. As mentioned, the adapter sleeve 140 is configured to position the tubular member 200 centrally within the inner gimbal module 130. This allows the central axis line of the tubular member 200 to be in substantial concentric alignment to the central axis line L1 of the gimbal assembly 100, as shown particularly in FIGS. 2*c*-2*d*. Accordingly, the tubular member is supported in an upright orientation while applying a hanging load acting parallel to the central axis line L1. In the case where the gimbal assembly 100 is installed on an offshore floating platform, the rotational axes R1 and R2 of the gimbal assembly 100 accommodates any pitching and rolling motion of the vessel due to external forces, including wave or current forces, to maintain the tubular member 200 in the upright orientation even when the floating platform is slanted or tilted. For example, the gimbal assembly 100 may be employed to provide a riser string, extending subsea from a marine vessel, with a compliant hang-off (or support) structure to prevent or reduce mechanical stresses, including bending stresses, arising within the riser string during adverse weather or sea conditions. Moreover, it should be appreciated that since the shaft collar 220 provides an adjustable hang-off position along the length of the riser string, the stroked-out length of the riser string can be controlled to prevent or reduce the risk of tubular buckling or twist-off from tensional stresses.

In another exemplary application, the inner and outer pivot pins 124 and 114 of the gimbal assembly 100 allow a tubular member 200, including drill or riser pipes, to rotate about the first and second rotational axes R1 and R2 of the gimbal assembly, as shown particularly in FIGS. 3*c* and 3*d*. For example, the inner and outer gimbal modules 130 and 120 of the gimbal assembly 100 provide the tubular member 200 with rotational compliance along lateral and longitudinal axes. In the case where the tubular member 200 is in connection with a column of tubular members (e.g., riser string) extending subsea, the rotational axes conferred by the gimbal modules 120 and 130 allow the column of tubular members to be deflected by an angle $\alpha$ in compliance to external forces, including wave or current forces, acting directly on the column of tubular members. This reduces cyclic bending stresses. In one embodiment, angle $\alpha$ is about 12 degrees (12°). For example, the gimbal modules 120 and 130 may allow the tubular member 200 to be deflected by about 12 degrees away from an upright position.

In addition, the bearing assembly 160 located within the passage 132 of the inner gimbal module 130 provides the riser string with full rotational compliance about the vertical axis R3 (e.g., yaw axis) to reduce torsional stresses applied by external forces. For example, the bearing assembly 160 allows the riser string to rotate freely around vertical axis R3. Further, it is to be appreciated that gravitational forces acting on the hanging load of the column of tubular members will induce the inner gimbal module 130 to self-right such that the central axis line T1 of the tubular member 200 self-realigns to the central axis line L1 of the gimbal assembly when the external forces subside, as shown particularly in FIGS. 2*c*-2*d*.

The gimbal assembly 100 may be advantageously used to provide a flexible hang-off arrangement for any suitable types of subsea equipment that requires a vertical load sitting on a pivoted support structure. The gimbal assembly 100 may also be adapted to pivotally support other forms of vertical load. Although, the gimbal assembly 100 is described as installed above sea level, it should be appreciated that the gimbal assembly may also be deployed below sea level, including mudline level, to support one or more tubular members in connection with a mud mat. In another exemplary subsea application, the gimbal assembly 100 may also be employed to facilitate drilling operations on a sloped seafloor. For example, the gimbal assembly may be mounted on the slots of a tilted subsea drilling template to pivotally support a drill string in an upright position. Alternatively, the gimbal assembly 100 may also be employed for any suitable onshore applications which require a pivoted support system.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. A gimbal assembly comprising:

a gimbal frame having a gimbal frame top and a gimbal frame bottom with a gimbal frame passage through the gimbal frame top and the gimbal frame bottom;

a first gimbal module concentrically disposed within the gimbal frame passage, wherein the first gimbal module comprises a first gimbal module passage through a first gimbal module top and a first gimbal module bottom;

a second gimbal module concentrically disposed within the first gimbal module passage, wherein the second gimbal module comprises a second gimbal module passage through a second gimbal module top and a second gimbal module bottom, wherein the second gimbal module extends above the first gimbal module top and the gimbal frame top; and an adapter sleeve disposed in an upper portion of the second gimbal module passage, wherein the adapter sleeve comprises an adaptor sleeve passage through an adapter sleeve top and an adaptor sleeve bottom, wherein the adapter sleeve top protrudes above the second gimbal module top, the adapter sleeve is configured to serve as a hang-off of a tubular membrane which can be slidably fitted though the first and second gimbal module passages, and transfer a load of the tubular membrane when the tubular membrane is hanging off the adaptor sleeve.

2. The gimbal assembly of claim 1 comprising a pair of outer pivot pins disposed diametrically opposite of each other in the gimbal frame, wherein the outer pivot pins extend beyond the gimbal frame to engage the first gimbal module.

3. The gimbal assembly of claim 2 comprising a pair of inner pivot pins disposed diametrically opposite of each other in the first gimbal module, wherein the inner pivot pins extend beyond the first gimbal module to engage the second gimbal module.

4. The gimbal assembly of claim 3 wherein the outer pivot pins define a first rotational axis of the gimbal assembly and the inner pivot pins define a second rotational axis of the gimbal assembly, wherein the first rotational axis is perpendicular to the second rotational axis.

5. The gimbal assembly of claim 4 wherein the first and second rotational axes are positioned along a same axial plane.

6. The gimbal assembly of claim 1 comprising a cylindrical bearing assembly disposed within the passage of the second gimbal module, wherein the bearing assembly comprises a vertical rotational axis which is aligned to a central axis line of the second gimbal module.

7. The gimbal assembly of claim 1 wherein the adaptor sleeve is slidably mounted on a bearing assembly of the second gimbal module, wherein the adaptor sleeve is configured to slide in a direction along the second gimbal module passage.

8. The gimbal assembly of claim 1 wherein the adapter sleeve passage comprises a smaller annular dimension relative to the second gimbal module passage.

9. The gimbal assembly of claim 1 wherein the gimbal assembly is configured to enable different size tubular members to be hung-off of the adaptor sleeve.

10. A pivotal hang-off system comprising:

a gimbal assembly comprising a gimbal frame with a passage therethrough, a first gimbal module disposed within the passage of the gimbal frame, wherein the first gimbal module comprises a passage therethrough, a second gimbal module disposed within the passage of the first gimbal module, wherein the second gimbal module comprises a passage therethrough, wherein the second gimbal module extends upwardly beyond the gimbal frame and first gimbal module, and an adapter sleeve disposed in the passage of the second gimbal module, wherein the adapter sleeve comprises a passage therethrough, wherein the adapter sleeve extends upwardly and protrudes above the second gimbal module; and a tubular member comprising a shaft collar removably fastened to an outer circumferential surface of the tubular member, wherein the tubular member is slidably mounted into the passage of the second gimbal module and the shaft collar is seated on the adapter sleeve.

11. The hang-off system of claim 10 wherein the gimbal assembly comprising a pair of outer pivot pins disposed diametrically opposite of each other in the gimbal frame, wherein the outer pivot pins extend beyond the gimbal frame to engage the first gimbal module.

12. The hang-off system of claim 11 wherein the gimbal assembly comprises a pair of inner pivot pins disposed diametrically opposite of each other in the first gimbal module, wherein the inner pivot pins extend beyond the first gimbal module to engage the second gimbal module.

13. The hang-off system of claim 12 wherein the outer pivot pins define a first rotational axis of the gimbal assembly and the inner pivot pins define a second rotational axis of the gimbal assembly, wherein the first rotational axis is perpendicular to the second rotational axis.

14. The hang-off system of claim 13 wherein the gimbal assembly comprises a cylindrical bearing assembly disposed within the passage of second gimbal module, wherein the adapter sleeve is slidably mounted onto the bearing assembly.

15. The hang-off system of claim 14 wherein the bearing assembly comprises a vertical rotational axis which is aligned to a central axis line of the second gimbal module.

16. The hang-off system of claim 10 wherein:

the gimbal frame comprises a first set of pivot apertures which are configured to accommodate a first pair of pivot pins to provide a first rotational axis for the first gimbal module; and the first gimbal module includes a second set of pivot apertures which are configured to accommodate a second pair of pivot pins to provide a second rotational axis for the second gimbal module.

17. The hang-off system of claim 16 wherein the passage of the adapter sleeve comprises a shallow radial groove disposed at an upper end of a cylindrical bore, wherein the shallow radial groove of the adapter sleeve is dimensioned to receive the shaft collar of the tubular member.

18. The hang-off system of claim 17 wherein an axial load of the tubular member is fully supported by the gimbal assembly by means of the shaft collar and the adapter sleeve.

19. The hang-off system of claim 10 wherein the second gimbal module comprises a ring-shape and the tubular member is positioned concentrically within the second gimbal module.

20. A system for obtaining natural resources subsea comprising:

a column of pipes dynamically supported by a gimbal assembly, wherein the gimbal assembly comprises a gimbal frame with a passage therethrough, a first gimbal module disposed within the passage of the gimbal frame, wherein the first gimbal module comprises a passage therethrough, a second gimbal module disposed within the passage of the first gimbal module, wherein the second gimbal module comprises a passage therethrough, wherein the second gimbal module extends upwardly beyond the gimbal frame and first gimbal module, and an adapter sleeve disposed in the passage of the second gimbal module, wherein the adapter sleeve comprises a passage therethrough, wherein the adapter sleeve extends upwardly and protrudes above the second gimbal module; and a shaft collar releasably fastened to the column of pipes, wherein the column of pipes is slidably mounted into the passage of the second gimbal module and the shaft collar engages the adapter sleeve, wherein the column of pipes extends from an offshore platform to below sea level and facilitates controlled routing of natural resources subsea.

* * * * *